US007731533B2

(12) United States Patent
Nguyen et al.

(10) Patent No.: US 7,731,533 B2
(45) Date of Patent: Jun. 8, 2010

(54) CONNECTOR SYSTEM HAVING A VIBRATION DAMPENING SHELL

(75) Inventors: Hung Thai Nguyen, Harrisburg, PA (US); Brent D. Yohn, Newport, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/261,141

(22) Filed: Oct. 30, 2008

(65) Prior Publication Data

US 2010/0112847 A1 May 6, 2010

(51) Int. Cl.
*H01R 13/648* (2006.01)
*H01R 13/627* (2006.01)

(52) U.S. Cl. ..... 439/607.23; 439/355

(58) Field of Classification Search ..... 439/355, 439/357, 353, 108, 607, 608, 609
See application file for complete search history.

(56) References Cited

U.S. PATENT DOCUMENTS

| | | | | |
|---|---|---|---|---|
| 4,866,704 | A | 9/1989 | Bergman | |
| 5,207,597 | A * | 5/1993 | Kline et al. | 439/607 |
| 5,570,270 | A | 10/1996 | Naedel et al. | |
| 5,775,946 | A * | 7/1998 | Briones | 439/607 |
| 6,135,816 | A * | 10/2000 | Mashiyama | 439/607 |
| 6,227,911 | B1 * | 5/2001 | Boutros et al. | 439/620.18 |
| 6,375,896 | B1 | 4/2002 | Wuske et al. | |
| 6,875,031 | B1 * | 4/2005 | Korsunsky et al. | 439/79 |
| 6,916,209 | B1 * | 7/2005 | Casher et al. | 439/676 |
| 6,981,086 | B2 | 12/2005 | Wetzel et al. | |
| 7,384,310 | B2 * | 6/2008 | Hu et al. | 439/607 |
| 2002/0080811 | A1 | 6/2002 | Wetzel et al. | |
| 2005/0213762 | A1 | 9/2005 | Hyland | |
| 2005/0216726 | A1 | 9/2005 | Dellmo et al. | |
| 2005/0216734 | A1 | 9/2005 | Yancy et al. | |
| 2005/0216750 | A1 | 9/2005 | Bricher et al. | |
| 2005/0216751 | A1 | 9/2005 | Dellmo et al. | |
| 2005/0216765 | A1 | 9/2005 | Petkus et al. | |
| 2006/0079112 | A1 | 4/2006 | Shuey et al. | |
| 2008/0014798 | A1 | 1/2008 | Pan | |
| 2008/0248658 | A1 | 10/2008 | Cohen et al. | |

FOREIGN PATENT DOCUMENTS

| | | |
|---|---|---|
| DE | 93 11 782 | 9/1993 |
| DE | 196 40 847 | 4/1998 |
| EP | 1 220 361 | 7/2002 |
| WO | WO 2008/079288 | 7/2008 |

OTHER PUBLICATIONS

International Search Report, International Application No. PCT/US2009/005906, International Filing Date Oct. 30, 2009.

* cited by examiner

*Primary Examiner*—Chandrika Prasad

(57) ABSTRACT

A connector system is provided that includes electrical connectors, a substrate and a vibration dampening shell. The connectors each have first and second sides. The substrate has an upper surface with the connectors mounted thereon. The shell limits movement of the connectors with respect to one another and is coupled to the first sides of the connectors to limit the movement of the connectors toward and away from the upper substrate. The shell also is coupled to the second sides of the connectors to limit the movement of the connectors in directions transverse to the upper substrate surface.

18 Claims, 5 Drawing Sheets

CONNECTOR SYSTEM HAVING A VIBRATION DAMPENING SHELL

BACKGROUND OF THE INVENTION

The subject matter herein generally relates to connector systems and, more particularly, to backplane connector systems.

Backplane connector systems include a backplane circuit board and one or more daughter circuit boards. The backplane circuit board may be referred to as a motherboard. The daughter circuit boards include electrical connectors that mate with corresponding electrical connectors mounted on the backplane circuit board. The connectors of the daughter circuit boards and the backplane circuit board mate with one another to electrically connect the daughter circuit boards with the backplane circuit board. Electric power, data signals, and the like may then be communicated between the daughter circuit boards and the backplane circuit board.

Some known backplane connector systems that are used in aircraft include connector systems designed according to the VMEbus computer bus standard or according to one or more of the computer bus standards set by the VITA organization. The backplane connector systems designed according to one or more of these standards may include daughter board connectors each having several card modules. These card modules are received in corresponding slots in the backplane circuit board connectors to electrically couple the daughter circuit board with the backplane circuit board.

Known backplane connector systems may be used in environments that experience mechanical vibration and mechanical shocks. For example, backplane connector systems may be used in aircraft and other vehicles where the backplane circuit board and daughter circuit boards may experience significant vibrations. In another example, backplane connector systems may be used in environments where sudden or abrupt movements may impart, mechanical shock to the connectors. The vibrations and mechanical shocks experienced by the daughter circuit boards in the backplane connector systems may cause individual connectors mounted to the daughter circuit boards to be damaged. The vibrations or shocks may cause individual connectors to move with respect to other connectors mounted to a circuit board. For example, the vibrations or shocks may cause the daughter board connectors to move in one or more directions with respect to neighboring daughter board connectors. The vibrations or shocks of the daughter board connectors may damage the connectors or otherwise disrupt the electrical communication between the daughter circuit board and the backplane circuit board. The daughter board connectors may become decoupled from the daughter circuit board or the daughter board connectors may be mechanically damaged. In backplane connector systems designed according to one or more of the VITA organization standards, the card modules in the daughter board connectors may be damaged or may be electrically decoupled from the daughter board connectors.

A need exists for a connector system that protects connectors mounted to a circuit board from damage caused by mechanical vibrations or other mechanical shocks. Protecting the connectors from mechanical damage caused by vibrations or shocks may prolong the useful life of the connector systems and may improve the robustness and reliability of the connector systems.

BRIEF DESCRIPTION OF THE INVENTION

In one embodiment, a connector system is provided that includes electrical connectors, a substrate and a vibration dampening shell. The connectors each have first and second sides. The substrate has an upper surface with the connectors mounted thereon. The shell limits movement of the connectors with respect to one another and is coupled to the first sides of the connectors to limit the movement of the connectors toward and away from the upper substrate. The shell also is coupled to the second sides of the connectors to limit the movement of the connectors in directions transverse to the upper substrate surface.

In another embodiment, another connector system is provided that includes a substrate and a vibration dampening shell. The substrate has electrical connectors mounted on an upper surface of the substrate. The shell limits movement of each connector with respect to the other connectors. The shell includes first and second shell bodies disposed transverse to one another. The first shell body is disposed approximately parallel to the upper substrate surface and is coupled to a first side of each of the connectors to limit the movement of each connector in opposing directions parallel to the upper substrate surface. The second shell body is coupled to a second side of each of the connectors to limit the movement of each connector in opposing directions transverse to the upper substrate surface. Optionally, the shell may include a third body mounted to a lower surface of the substrate that opposes the upper surface. The first and third shell bodies may be separated from one another by a loading opening through which the connectors mate with other electrical connectors.

DETAILED DESCRIPTION OF THE INVENTION

Figure 1:
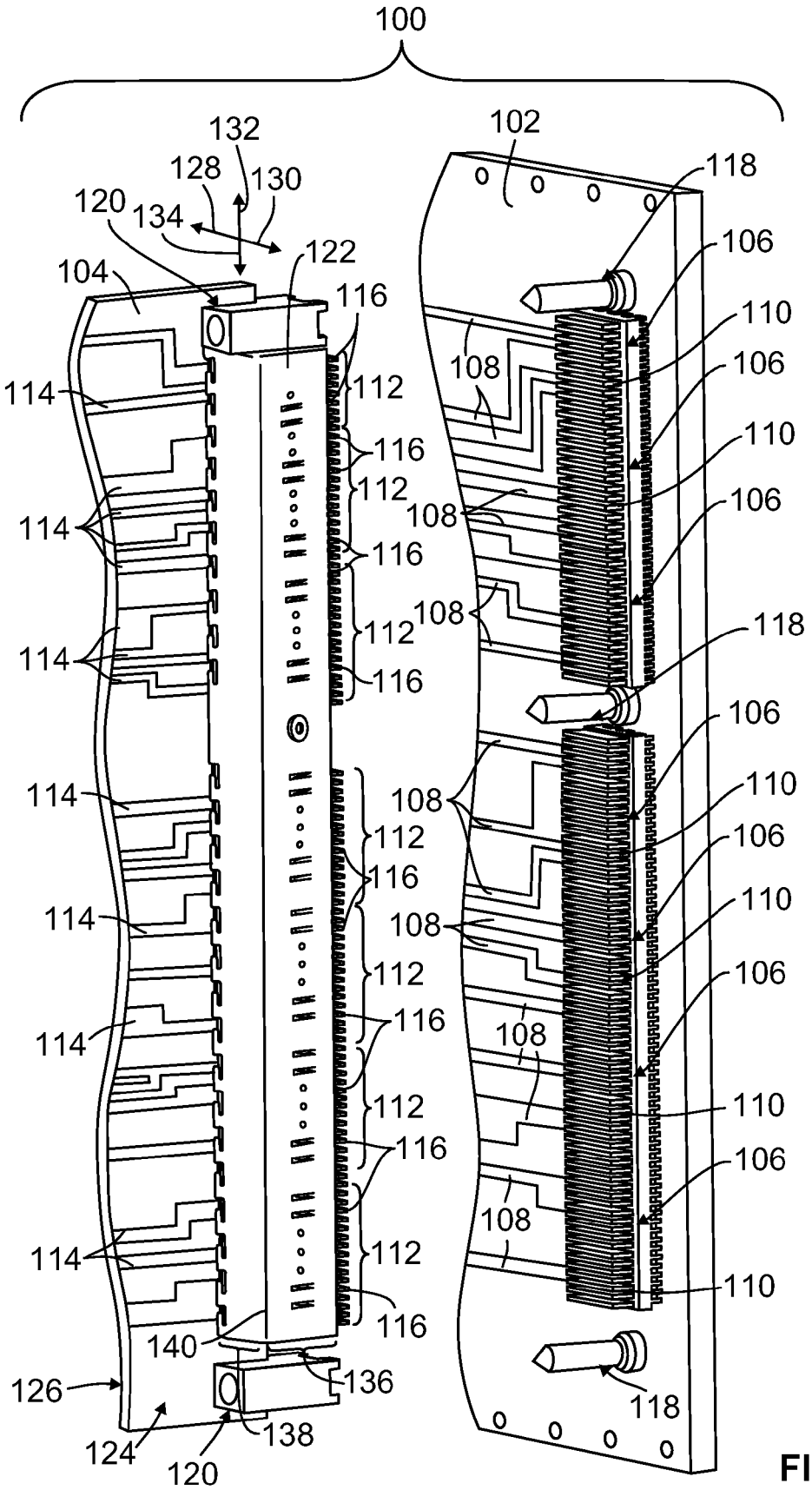
FIG. 1 is a perspective view of a connector system according to one embodiment.

FIG. 1 is a perspective view of a connector system 100 according to one embodiment. The connector system 100 includes a backplane board 102 that couples with a daughter board 104 to permit communication of data signals and/or power signals between the backplane board 102 and the daughter board 104. While the connector system 100 is described herein in terms of a backplane connector system, the disclosure provided herein applies to connector systems other than backplane connector systems. The backplane board 102 and the daughter board 104 are substrates that support electrical connectors and other peripheral components of the connector system. The backplane board 102 and daughter board 104 may be embodied in circuit boards, such as a printed circuit board, for example. The backplane board 102 may constitute a motherboard or, alternatively, the backplane board 102 may be a portion of a motherboard. Several backplane electrical connectors 106 are mounted on the backplane board 102. The backplane connectors 106 are electrically joined with conductive pathways 108 in the backplane board 102. The conductive pathways 108 may be conductive traces in a printed circuit board, for example. Several mating electrical connectors 112 are mounted on the daughter board 104. The mating connectors 112 are mounted on an upper surface 124 of the daughter board 104 that opposes a lower surface 126. The mating connectors 112 are electrically joined with conductive pathways 114 in the daughter board 104. The conductive pathways 114 may be embodied in one or more conductive traces in a printed circuit board, for example.

The backplane board 102 and the daughter board 104 mate with one another to electrically couple the backplane connectors 106 with the mating connectors 112. In the illustrated embodiment, the mating connectors 112 are MultiGig® electrical connectors each having several card modules 116 and the backplane connectors 106 include card module slots 110 that are shaped to receive the card modules 116. For example, the card module slots 110 receive the card modules 116 when the mating connectors 112 and backplane connectors 106 mate with one another. The mating connectors 112 and backplane connectors 106 may communicate differential pair signals, power signals, RF signals, and the like, between the daughter board 104 and the backplane board 102. In one embodiment, the mating connectors 112 include seven card modules 116. Alternatively, the mating connectors 112 include sixteen card modules 116. The number of card modules 116 in the various mating connectors 112 may be varied in the connector system 100. For example, some of the mating connectors 112 may include seven card modules 116 while other mating connectors 112 may include sixteen card modules 116. While the mating connectors 112 are shown as including the card modules 116, alternatively the backplane connectors 106 include the card modules 116 and the mating connectors 112 include the slots 110. The mating connectors 112 and backplane connectors 106 may electrically couple with one another using components other than the card modules 116 and slots 110. For example, the mating connectors 112 may include contact pins (not shown) and the backplane connectors 106 may include pin receptacles (not shown) that are shaped to receive the contact pins.

Multiple alignment pins 118 are mounted to and orthogonally protrude from the backplane board 102. Several pin receptacles 120 are mounted to the daughter board 104. The alignment pins 118 are received in the pin receptacles 120 when the backplane board 102 and the daughter board 104 mate with one another. The alignment pins 118 mechanically align the backplane board 102 and daughter board 104, and the backplane connectors 106 and the mating connectors 112, with respect to one another. While the daughter board 104 and backplane board 102 are shown as mating with one another in an orthogonal relationship, alternatively the daughter board 104 and the backplane board 102 may mate with one another in a coplanar or parallel relationship. For example, the alignment pins 118 may be mounted to the backplane board 102 such that the alignment pins 118 extend in a direction parallel to the backplane board 102. Loading the alignment pins 118 into the pin receptacles 120 then locates the backplane board 102 and the daughter board 104 in a coplanar or parallel Relationship. Alternatively, the pin receptacles 120 may be orthogonally mounted to the daughter board 104 such that loading the alignment pins 118 into the pin receptacles 120 provides the backplane board 102 and the daughter board 104 in a coplanar or parallel relationship.

A vibration dampening shell 122 is coupled to each of the mating connectors 112 to inhibit movement of the mating connectors 112 with respect to one another. The shell 122 is coupled to the mating connectors 112 to stiffen the mating connectors 112 with respect to one another. Stiffening the mating connectors 112 provides additional mechanical support for the mating connectors 112 and may reduce mechanical damage caused to the mating connectors 112 by vibrations or mechanical shocks. The shell 122 may inhibit movement of the mating connectors 112 in a variety of directions with respect to the daughter board 104. For example, the shell 122 may limit movement of the mating connectors 112 in opposite directions 128, 130 toward and away from the daughter board 104. The opposite directions 128, 130 may be referred to as up and down directions with respect to the daughter board 104. The shell 122 may limit movement of the mating connectors 112 in opposite lateral directions 132, 134 that oppose one another and that are transverse to the opposite directions 128, 130. In one embodiment, the opposite directions 128, 130 and the lateral directions 132, 134 are orthogonal to one another. The shell 122 may limit movement of the mating connectors 112 in other directions that are transverse or otherwise angled with respect to the opposite directions 128, 130 or lateral directions 132, 134.

The shell 122 includes an upper planar body 136 joined to a rear planar body 138. The upper body 136 continuously extends across all of a top side 208 of the mating connectors 112 in the illustrated embodiment to interconnect the mating connectors 112 with one another. The rear body 138 continuously extends across all of a rear side 206 of the mating connectors 112 in the illustrated embodiment to interconnect the mating connectors 112 with one another. The bodies 136, 138 are separated by a fold line 140. The shell 122 may be formed from a common sheet of material by bending the sheet to create the bodies 136, 138 and the fold line 140. For example, the shell 122 may be created by stamping and forming a sheet of conductive material. Alternatively, the shell 122 may be formed by joining two separated bodies 136, 138 together. For example, two separate bodies 136, 138 created from a sheet of metal may be welded or otherwise joined together by an adhesive. The shell 122 includes a lower planar body 400 (shown in FIG. 4) that is mounted to the lower surface 126 of the daughter card 104 in one embodiment, as described below.

In one embodiment, the connector system 100 is a VITA46 or VMEbus standard connector system. The connector system 100 may be used in an environment subjected to mechanical vibration and shock. For example, the connector system 100 may be used in aircraft or other vehicles. As described above, the useful lives of connectors in environments experiencing relatively large vibrations and shock may be severely shortened. The shell 122 is provided to reduce the vibrations and mechanical shocks to the mating connectors 112 in the connector system 100 and therefore increase the useful life of the mating connectors 112 and the connector system 100. The shell 122 acts as a stiffening element or body that reduces vibrations in the mating connectors 112. For example, the shell 122 may interconnect several of the mating connectors 112 to limit movement of individual mating connectors 112 with respect to one another. Limiting the individual movements of the mating connectors 112 may reduce the vibrations and limit the mechanical shock to the mating connectors 112, thus increasing the useful lives of the mating connectors 112 and connector system 100.

Figure 2:
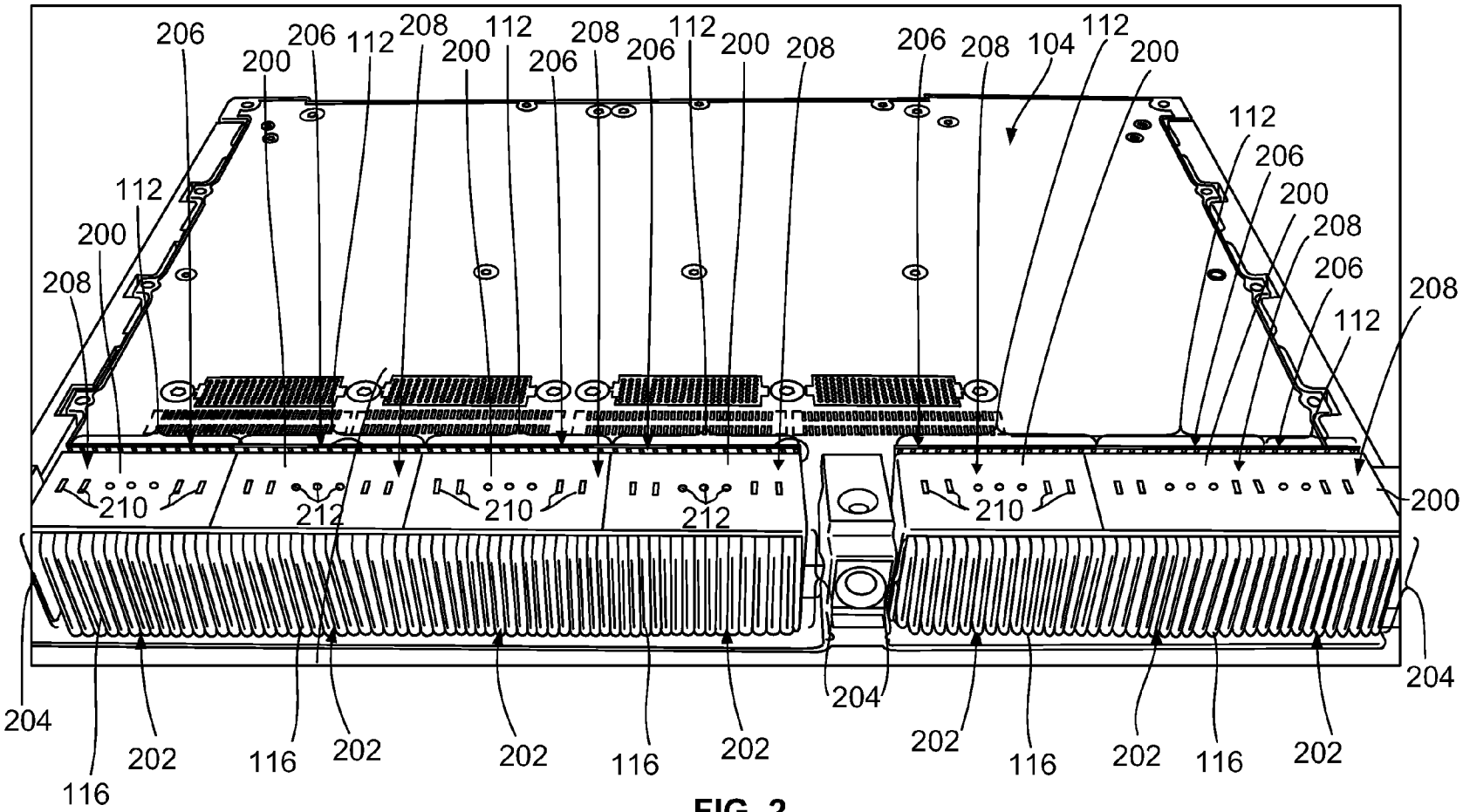
FIG. 2 is a perspective view of a daughter board and mating connectors shown in FIG. 1 with a shell shown in FIG. 1 removed.

FIG. 2 is a perspective view of the daughter board 104 and mating connectors 112 with the shell 122 shown in FIG. 1 removed. The mating connectors 112 include a housing 200 that holds the card modules 116. The housing 200 may be formed from a dielectric material, such as a polymer. The housing 200 includes a mounting face 202 that is mounted to the daughter board 104. The mounting face 202 includes the portion of the housing 200 that engages the daughter board 104 to mount the mating connector 112 to the daughter board 104. The housing 200 includes a mating face 204 in which the card modules 116 are held for mating with the backplane connectors 106 (shown in FIG. 1). The card modules 116 are arranged in the mating face 204 such that the card modules 116 are received in the slots 110 (shown in FIG. 1) of the backplane connectors 106, as described above. In the illustrated embodiment, the mounting face 202 and the mating face 204 are orthogonal to one another. Alternatively, the mounting face 202 and the mating face 204 may be parallel to one another or transverse with respect to one another at an angle other than ninety degrees.

The housing 200 includes the rear side 206 and the top side 208. The rear side 206 extends between the mounting face 202 and the top side 208. In the illustrated embodiment, the rear side 206 opposes the mating face 204. The rear side 206 may be parallel to the mating face 204 or may be disposed at a transverse angle with respect to the mating face 204. The top side 208 extends between the mating face 204 and the rear side 206. In the illustrated embodiment, the top side 208 opposes the mounting face 202. The top side 208 intersects the rear side 206. The top side 208 may be parallel to the mounting face 202 or may be disposed at a transverse angle with respect, to the mounting face 202. The housing 200 is formed as a cuboid, or a three-dimensional rectangular box, with the mounting face 202, mating face 204, rear side 206 and top side 208 orthogonal to one another. Other shapes of the housing 200 are possible and within the scope of the embodiments described herein. For example, the top side 208 and rear side 206 may not intersect one another. In another example, the mating face 204 and mounting face 202 may be parallel as opposed to transverse to one another.

The shell 122 (shown in FIG. 1) is coupled to each of the mating connectors 112. The shell 122 may be joined to common surfaces of each of the mating connectors 112. For example, each mating connector 112 may have a common, or similar, top side 208. The shell 122 may be fixed to the common top sides 208 of the mating connectors 112. The shell 122 may be fixed to the top sides 208 by directly engaging the shell 122 to the top sides 208 with no intervening structure or component disposed between the shell 122 and the top sides 208. Each mating connector 112 includes a common, or similar rear side 206 in the illustrated embodiment. The shell 122 may be fixed to the common rear sides 206 of the mating connectors 112. The shell 122 may be fixed to the rear sides 206 by directly engaging the shell 122 to the rear sides 206 with no intervening structure or component disposed between the shell 122 and the rear sides 206.

The housing 200 includes retention features that assist in securing the shell 122 (shown in FIG. 1) to the mating connectors 112. For example, the top side 208 of the housing 200 may include several latch cavities 210 that extend into the housing 200 from the top side 208. The latch cavities 210 are shaped to receive latching elements 300 (shown in FIG. 3) of the shell 122 to secure the shell 122 to the housing 200. The housing 200 may include protrusions 212 that extend away from the top side 208. The protrusions 212 are shaped to be loaded into corresponding through holes 302 (shown in FIG. 3) of the shell 122 to secure the shell 122 to the housing 200. For example, the protrusions 212 may be pins that are shaped to be received in the through holes 302. The housing 200 may include both the latch cavities 210 and the protrusions 212, or may only include the latch cavities 210 or the protrusions 212. Moreover, the number of latch cavities 210, protrusions 212 or other retention features of the housing 200 may be varied from those shown in FIG. 2.

Figure 3:
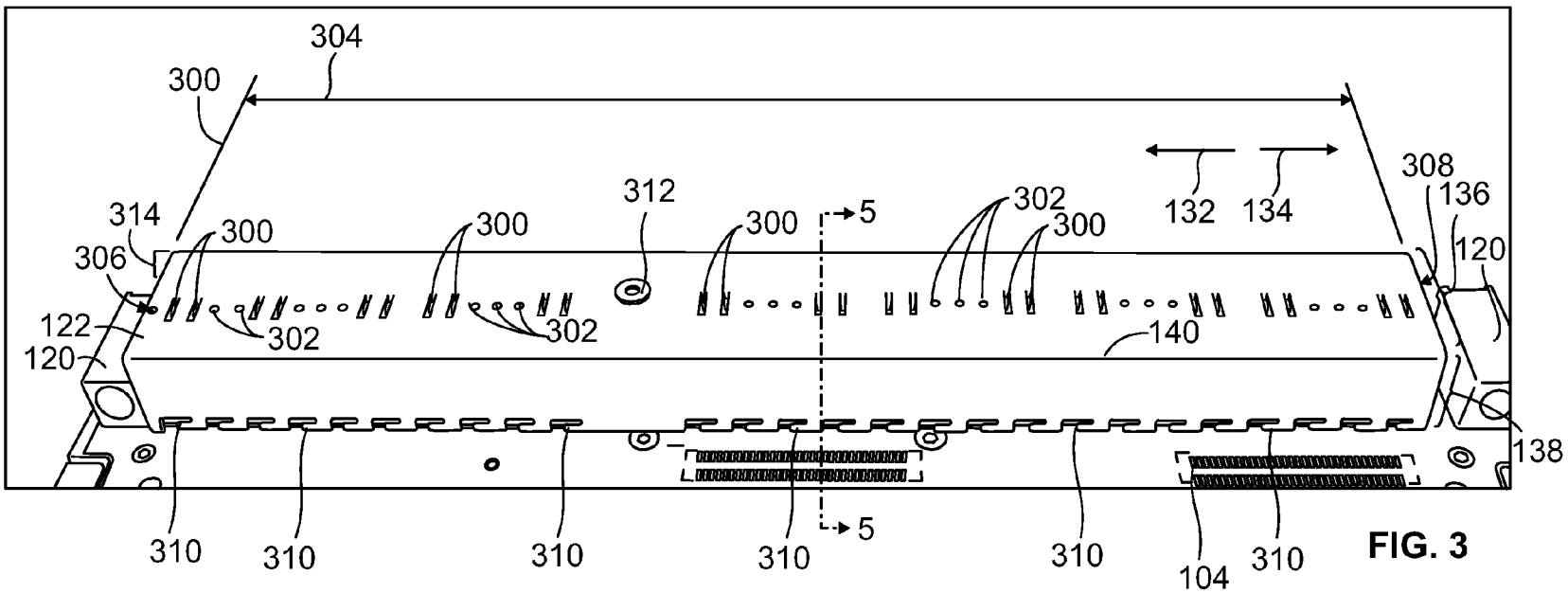
FIG. 3 is a rear perspective view of the shell shown in FIG. 1 mounted to the mating connectors shown in FIG. 1.

FIG. 3 is a rear perspective view of the shell 122 mounted to the mating connectors 112 (shown in FIG. 1). The shell 122 has a width dimension 304 between opposite outer ends 306, 308 of the shell 122. The width dimension 304 is measured in a direction parallel to the daughter board 104 and to the lateral directions 132, 134. The width dimension 304 may be the same or different for each of the bodies 136, 138 of the shell 122. The width dimension 304 may be great enough to interconnect all of the mating connectors 112 with the shell 122. Alternatively, the shell 122 may not interconnect all of the mating connectors 112. For example, the shell 122 may interconnect a subset of the mating connectors 112 mounted to the daughter board 104.

The shell 122 includes latching elements 300 that extend downward from the upper body 136 of the shell 122. The latching elements 300 include portions of the upper body 136 that engage the housings 200 (shown in FIG. 2) of the mating connectors 112 (shown in FIG. 1) to limit movement of the mating connectors 112 with respect to one another and to the shell 122. For example, the latching elements 300 may be formed from portions of the upper body 136 that are bent downward and received in the latch cavities 210 (shown in FIG. 2) of the housings 200. The shell 122 includes the through holes 302 that extend through the upper body 136. As described above, the through holes 302 may receive the protrusions 212 (shown in FIG. 2) of the mating connectors 112 to secure the shell 122 to the mating connectors 112 and limit movement of the mating connectors 112 with respect to one another and to the shell 122.

The shell 122 includes several fingers 310 that extend inward from the rear body 138 into the mating connectors 112 (shown in FIG. 1). Similar to the latching elements 300, the fingers 310 include portions of the rear body 138 that are inserted into the housings 200 (shown in FIG. 2) of the mating connectors 112. The fingers 310 may be formed from portions of the rear body 138 that are bent inward and received in finger cavities 518 (shown in FIG. 5) in the rear sides 206 (shown in FIG. 2) of the housings 200. The fingers 310 are loaded into the finger cavities 518 to limit movement of the mating connectors 112 with respect to one another and to the shell 122.

While the shell 122 is illustrated in FIG. 3 as including all of the latching elements 300, the through holes 302 and the spring fingers 310 to secure the shell 122 to the mating connectors 112 (shown in FIG. 1), the shell 122 may include a different number of or none of one or more of the latching elements 300, through holes 302, and spring fingers 310. For example, the shell 122 may include no through holes 302. In one embodiment, another component to the connector system 100 shown in FIG. 1 may be introduced to secure the shell 122 to the mating connectors 112. By way of example only, an adhesive may be disposed between the mating connectors 112 and the shell 122. For example, an adhesive may be provided on the top side 208 (shown in FIG. 2) and/or rear side 206 (shown in FIG. 2) of the housings 200 (shown in FIG. 2) of the mating connectors 112 prior to placing the shell 122 in contact with the adhesive and mating connectors 112. The adhesive may bond the shell 122 to the mating connectors 112 to limit movement of the mating connectors 112.

The shell 122 may be coupled to one or more of the pin receptacles 120. For example, a fastener 312 may be placed through the shell 122 and secured to a pin receptacle 120 that is partially enclosed by the shell 122 to secure the shell 122 to the pin receptacle 120. The fastener 312 may include a threaded screw that is coupled to the pin receptacle 120 by screwing the fastener 312 into a threaded bore in the pin receptacle 120. The shell 122 may be electrically joined to a conductive pathway 114 (shown in FIG. 1) by the fastener 312 and pin receptacle 120. For example, the pin receptacle 120 may include a conductive material and be electrically coupled to a ground reference of the daughter board 104 by a conductive pathway 114. The fastener 312 may include a conductive material and provide an electrically conductive path from the shell 122 to the ground reference of the daughter board 104 through the pin receptacle 120. Alternatively, the shell 122 may be connected to the ground reference of the daughter board 104 in another manner. For example, the shell 122 may be mounted to the daughter board 104 and coupled to the ground reference by a conductive pathway 114.

The upper body 136 of the shell 122 include a guidance edge 314 located on a side of the upper body 136 opposite the fold line 140 between the upper and rear bodies 136, 138. The guidance edge 314 includes a portion of the upper body 136 that protrudes past the mating faces 204 (shown in FIG. 2) of the mating connectors 112 (shown in FIG. 1). Alternatively, the guidance edge 314 may not protrude past, the mating faces 204 of the mating connectors 112. The guidance edge 314 guides the mating connectors 112 and the backplane connectors 106 into a mating engagement. For example, the guidance edge 314 may receive the backplane connectors 106 and guide the backplane connectors 106 toward the mating faces 204 of the mating connectors 112 as the mating connectors 112 and the backplane connectors 106 are brought together to mate the connectors 112, 106 with one another.

In one embodiment, the guidance edge 314 projects past the mating faces 204 to protect the mating connectors 112 from electrostatic discharge ("ESD"). The guidance edge 314 may project past the mating faces 204 of the mating connectors 112 so that a source of electrostatic energy that is external to the connector system 100 (shown in FIG. 1) contacts the guidance edge 314 prior to or instead of touching the mating connectors 112 or the card modules 116 (shown in FIG. 1) held in the mating connectors 112. For example, an operator of the connector system 100 may be a source of electrostatic energy. The operator's fingers may touch the guidance edge 314 instead of the mating connectors 112 as the operator mates the backplane connectors 106 (shown in FIG. 1) with the mating connectors 112. As described above, the shell 122 may be electrically coupled to the ground reference of the daughter board 104. The operator's contact with the guidance edge 314 may discharge the electrostatic energy of the operator and electrically connect the electrostatic energy with the ground reference of the daughter board 104.

Figure 4:
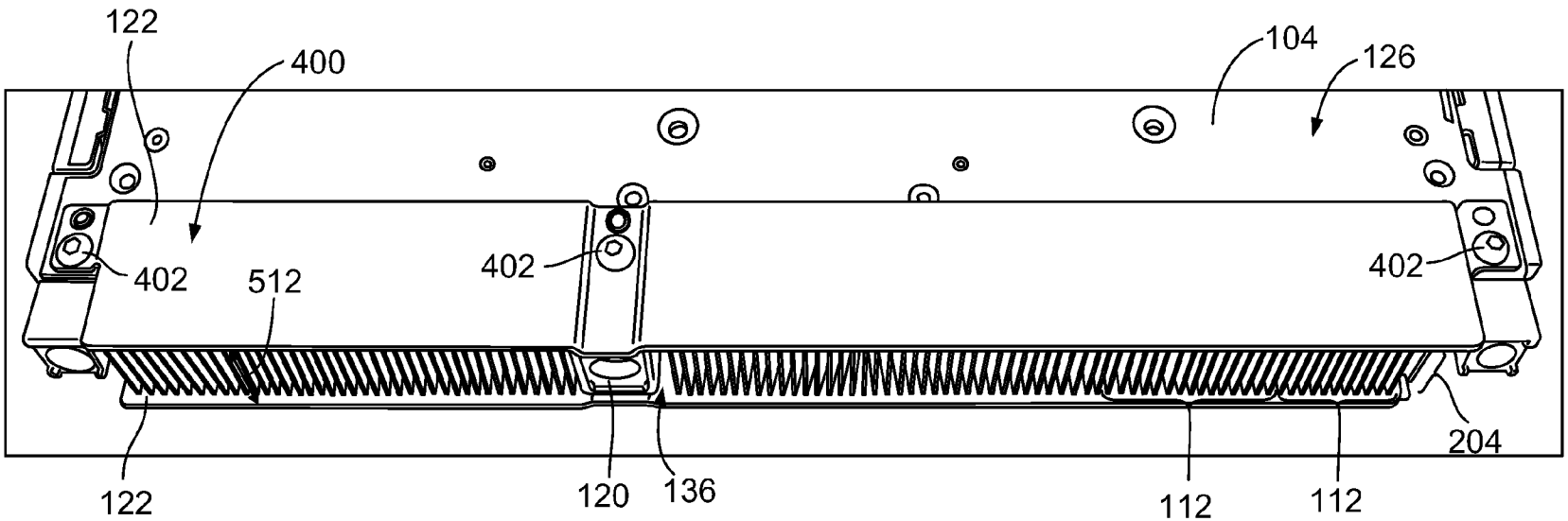
FIG. 4 is a perspective view of a lower surface of the daughter board shown in FIG. 1 and a lower body of the shell shown in FIG. 1 according to one embodiment.

FIG. 4 is a perspective view of the lower surface 126 of the daughter board 104 and the lower body 400 of the shell 122 according to one embodiment. The lower body 400 includes a substantially planar body. The lower body 400 may be stamped and formed from a sheet of conductive material, such as a metal. The lower body 400 may be fixed to the daughter board 104 by one or more fasteners 402. The fasteners 402 may be similar to the fastener 312 shown in FIG. 3 and may mechanically affix the lower body 400 to the daughter board 104 and electrically couple the lower body 400 to the ground reference of the daughter board 104 via a conductive pathway 114. In one embodiment, the lower body 400 is electrically connected with the upper body 136 and the rear body 138 (shown in FIG. 1) of the shell 122. For example, one of the fasteners 402 may electrically couple the lower body 400 with a pin receptacle 120 that includes an electrically conductive material. The fastener 312 also may electrically couple the upper body 136 with the same pin receptacle 120. The electrically conductive material in the pin receptacle 120 may provide an electrically conductive pathway between the fasteners 402, 312 and the upper and lower bodies 136, 400 of the shell 122.

Similar to the upper body 136, the lower body 400 may protrude past the mating faces 204 of the mating connectors 112. The lower body 400 may protrude past the mating faces 204 to guide the backplane connectors 106 (shown in FIG. 1) and the mating connectors 112 into a mating relationship with one another, similar to the guidance edge 314 of the upper body 136. For example, the distance between the upper body 136 and lower body 400 of the shell 122 may define the loading opening 512 through which the backplane connectors 106 (shown in FIG. 1) may be loaded to mate with the mating connectors 112.

In one embodiment, the lower body 400 projects past the mating faces 204 to protect the mating connectors 112 from ESD, similar to the guidance edge 314. The lower body 400 may project past the mating faces 204 so that a source of electrostatic energy external to the connector system 100 (shown in FIG. 1) contacts the lower body 400 prior to or instead of touching the mating connectors 112 or the card modules 116 (shown in FIG. 1), similar to as described above in connection with the guidance edge 314.

Figure 5:
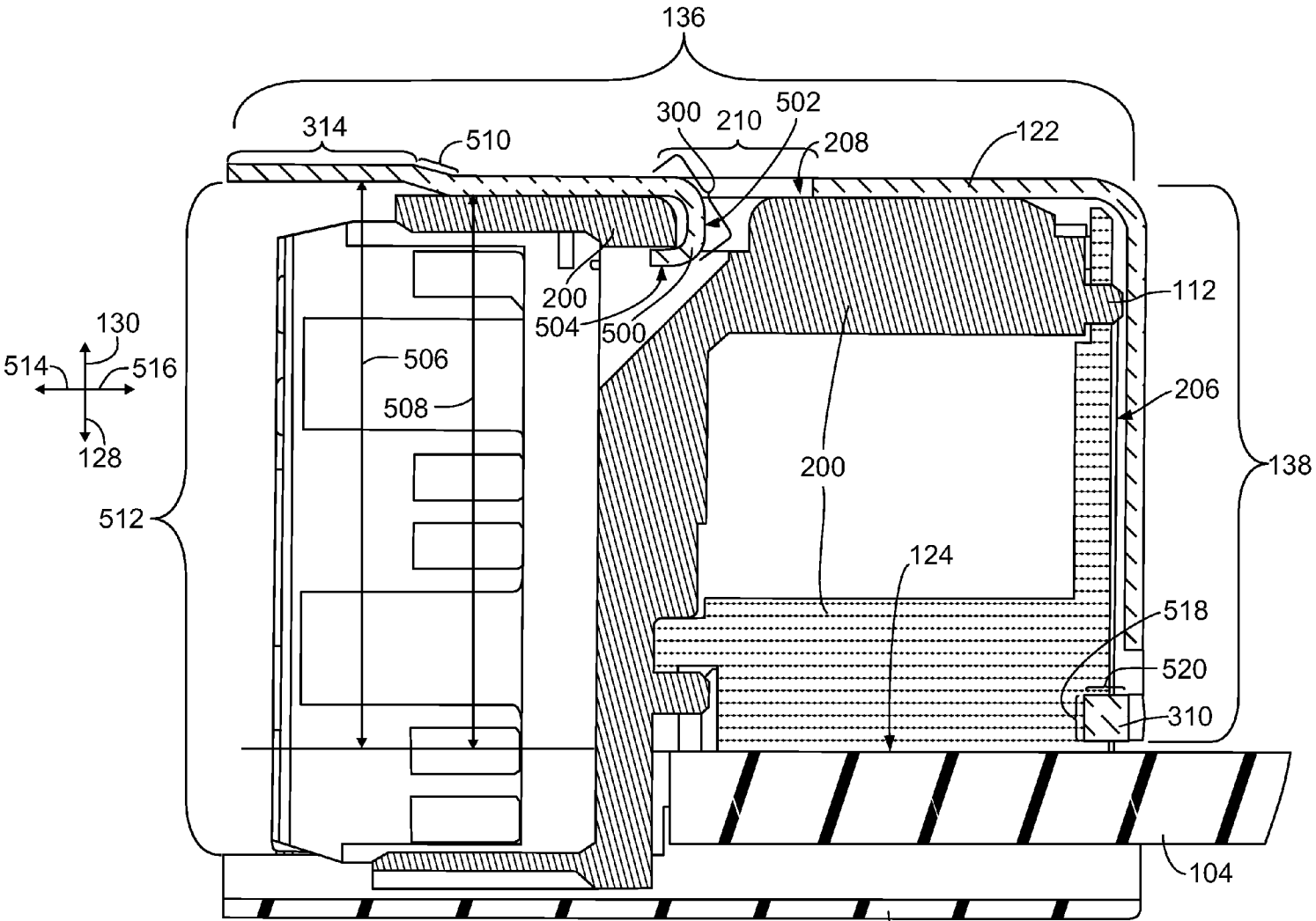
FIG. 5 is a cross-sectional view of the shell, mating connectors and daughter board shown in FIG. 1 taken along line 5-5 in FIG. 3.

FIG. 5 is a cross-sectional view of the shell 122, mating connectors 112 and daughter board 104 taken along line 5-5 in FIG. 3. As shown in FIG. 5, the upper body 136 of the shell 122 extends along the top sides 208 of the mating connector housings 200. The latching elements 300 extend from the upper body 136 downward into the latch cavities 210 in the housings 200. In the illustrated embodiment, the latching elements 300 include a hook extension 500 that extends into and engages the housing 200. The hook extension 500 includes a penetrating portion 502 and a securing portion 504. The penetrating portion 502 extends away from the upper body 136 toward the daughter board 104 and into, the latch cavity 210. The penetrating portion 502 may extend away from the upper body 136 in a direction that is substantially perpendicular to the upper body 136. Alternatively, the penetrating portion 502 may extend away from the upper body 136 in a different direction. The securing portion 504 is connected to the upper body 136 by the penetrating portion 502. The securing portion 504 extends from the penetrating portion 502 in a direction that is transverse to the penetrating portion 502. For example, the securing portion 504 may extend from the penetrating portion 502 in a direction that is transverse to the penetrating portion 502. For example, the securing portion 504 may be disposed substantially perpendicular to the penetrating portion 502 or parallel to the upper body 136. The penetrating portion 502 penetrates into the latch cavity 210 and positions the securing portion 504 in a location to secure the upper body 136 to the housing 200. In an alternative embodiment, the latching element 300 does not include the hook extension 500. For example, the latching element 300 may include an extension (not shown) similar to the penetrating portion 502 that penetrates into the latch cavity 210 but that is not connected to the securing portion 504.

As described above, the latching element 300 extends into the latching cavity 210 to secure the mating connector 112 to the shell 122. The latching elements 300 secure multiple mating connectors 112 to the shell 122 in order to limit the movement or displacement of the individual mating connectors 112 with respect to one another. For example, the latching elements 300 may restrict movement of the mating connectors 112 in the lateral directions 132, 134 (shown in FIG. 1). The latching elements 300 also may restrict movement of the mating connectors 112 with respect to one another in one or more of the transverse directions 514, 516. The transverse directions 514, 516 are orthogonal to the lateral directions 132, 134 and the opposite directions 128, 130 in one embodiment.

The rear body 138 of the shell 122 extends along the rear sides 206 of the mating connector housings 200. The fingers 310 extend from the rear body 138 in a direction transverse to the rear body 138 and into the finger cavities 518 of the housings 200. For example, the fingers 310 may extend from the rear body 138 in a substantially perpendicular direction with respect to the rear body 138. In the illustrated embodiment, the fingers 310 include a substantially planar body 520 that extends into the finger cavity 518 and engages the housing 200. Alternatively, the fingers 310 may include a securing portion similar to the securing portion 504 of the latching elements 300. For example, the fingers 310 may include a hook to secure the rear body 138 to the housings 200.

As described above, the finger 310 extends into the finger cavity 518 to secure the mating connector 112 to the shell 122. The fingers 310 secure multiple mating connectors 112 to the shell 122 in order to limit the movement or displacement of the individual mating connectors 112 with respect to one another. For example, the fingers 310 may restrict movement of the mating connectors 112 in the opposite directions 128, 130, or in directions toward and away from the daughter board 104. The fingers 310 also may restrict movement of the mating connectors 112 with respect to one another in one or more of the transverse directions 514, 516 and lateral directions 132, 134 (shown in FIG. 1).

The guidance edge 314 of the upper body 136 may be bent away from the plane of the upper body 136. For example, a bend 510 between the guidance edge 314 and the remainder of the upper body 136 may displace the guidance edge 314 farther away from the upper surface 124 of the daughter board 104 than the remainder of the upper body 136. The bend 510 locally increases the size of the loading opening 512 proximate to the guidance edge 314. In one embodiment, a first dimension 506 between the guidance edge 314 and the upper surface 124 of the daughter board 104 may be greater than a second dimension 508 between the portion of the upper body 136 that does not include the guidance edge 314 and the upper surface 124. The dimensions 506, 508 are measured in a direction perpendicular to the upper surface 124. The displacement of the guidance edge 314 farther from the daughter board 104 than the remainder of the upper body 136 provides a larger loading opening 512 in which to mate the backplane connectors 106 (shown in FIG. 1) and the mating connectors 112. For example, the backplane connectors 106 are loaded through the loading opening 512 to mate with the mating connectors 112. Increasing the size of the loading opening 512 by bending the guidance edge 314 away from the daughter board 104 provides increased mechanical tolerance in the mating of the backplane connectors 106 and the mating connectors 112.

As described above, additional components may be added to the connector system 100 shown in FIG. 1 to limit the movement of the mating connectors 112 with respect to one another. For example, adhesive may be applied to between the housing 200 and the shell 122 to bond the mating connectors 112 and shell 122 together. In another example, a Vibration dampening component (not shown) may be provided between the mating connectors 112 and/or between the mating connectors 112 and the shell 122. The vibration dampening component may include a rubber or foam sheet or body placed between the mating connectors 112 and/or between the mating connectors 112 and the shell 122. The vibration dampening component may absorb relatively small movements of individual mating connectors 112 to limit the impact of the vibration of one mating connector 112 on the other mating connectors 112.

The connector system 100 described herein may extend the useful life of the mating connectors 112 by reducing the vibrations and mechanical shocks experienced by the mating connectors 112. The connector system 100 reduces the vibrations and shocks experienced by the mating connectors 112 by interconnecting the mating connectors 112 with the vibration dampening shell 122. The shell 122 acts as a stiffening element in the system 100 that inhibits or limits individual movements of the mating connectors 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

electrical connectors each holding one or more card modules, each of the connectors having a top side, a rear side and a bottom side configured to be mounted on an upper surface of a substrate; and a vibration dampening shell having an upper body and a rear body, the upper body coupled to the top sides of the connectors to limit lateral movement of the connectors in lateral directions with respect to the upper surface of the substrate, the rear body coupled to the rear sides of the connectors to limit transverse movement of the connectors in directions that are transverse to the lateral directions, wherein the rear body of the shell is disposed transverse to the upper surface of the substrate, the rear body continuously spanning the rear sides of the connectors to interconnect the connectors with one another.

2. The connector system of claim 1, wherein the upper body of the shell is disposed approximately parallel to the upper surface of the substrate and continuously spans the top sides of the connectors to interconnect the connectors with one another.

3. The connector system of claim 1, wherein the upper and rear bodies of the shell are planar bodies disposed transverse to one another, the upper body oriented approximately parallel to the upper surface of the substrate, the rear body oriented transverse to the upper surface of the substrate.

4. The connector system of claim 1, wherein the substrate comprises a lower surface disposed opposite of the upper surface and the shell comprises a lower body that is separate from the upper and rear bodies, the lower body mounted to the lower surface of the substrate and separated from the upper body of the shell by a loading opening to receive external connectors therethrough to mate with the card modules of the connectors mounted on the substrate.

5. The connector system of claim 4, wherein the connectors have mating faces that receive the external connectors, each of the upper and lower bodies of the shell having a portion that outwardly protrudes beyond the mating faces in directions away from the rear body of the shell, the portions of the upper and lower bodies guiding the card modules in the connectors and the external connectors into a mating engagement with one another.

6. The connector system of claim 4, wherein the shell comprises a guidance edge extending from at least one of the upper and lower bodies, the guidance edge bent away from the substrate to increase the loading opening proximate to the guidance edge.

7. The connector system of claim 1, wherein the shell is electrically joined to an electrical ground of the substrate to discharge electrostatic energy from an external source.

8. The connector system of claim 1, wherein the connectors include cavities extending into the top sides of the connectors and the shell comprises latching elements extending into the cavities to limit the lateral movement of the connectors.

9. The connector system of claim 1, wherein the connectors include openings in the rear sides of the connectors and the shell comprises fingers extending into the openings to limit the transverse movement of the connectors.

10. A connector system comprising:

mounted connectors each including one or more card modules and joined to an upper surface of a substrate, the mounted connectors including top and rear transverse sides; and a vibration dampening shell including an upper body and a separate lower body electrically coupled with one another and to an electric ground reference, the upper body continuously spanning across and coupled to at least one of the top and rear sides of the connectors to limit individual movement of the mounted connectors, the lower body mounted to a lower surface of the substrate and separated from the upper body by a loading opening that receives mating connectors that mate with the mounted connectors, wherein the shell is joined with the electric ground reference to discharge electrostatic energy.

11. The connector system of claim 10, wherein the mounted connectors include openings in the rear sides and the shell comprises fingers extending into the openings of the mounted connectors in a direction that is oriented parallel to the upper surface of the substrate, the fingers limiting movement of the mounted connectors with respect to the shell in directions that are transverse to the upper surface of the substrate.

12. The connector system of claim 10, wherein the upper body of the shell includes a guidance edge bent away from the substrate to increase a size of the loading opening.

13. The connector system of claim 10, wherein the shell is electrically coupled to an electrical ground of the substrate to discharge electrostatic energy from an external source.

14. The connector system of claim 10, wherein the top sides of the mounted connectors include openings and the upper body of the shell comprises latching elements having protrusion portions joined to securing portions that are angled with respect to one another, the protrusion portions protruding into the openings of the mounted connectors and the securing portions hooking the mounted connectors to secure the mounted connectors to the shell.

15. The connector system of claim 10, wherein the mounted connectors have mating faces that mate with the mating connectors and the upper and lower bodies of the shell include portions that protrude past the mating faces in directions away from the rear body of the shell, the portions of the upper and lower bodies guiding the mating connectors and the mounted connectors into a mating engagement with one another.

16. The connector system of claim 10, further including a fastener joined with the upper and lower bodies of the shell and extending through the substrate, wherein the upper and lower bodies are mechanically and electrically connected with one another and the substrate by the fastener.

17. The connector system of claim 10, wherein the card modules are configured to mate with the mating connectors through the loading opening.

18. The connector system of claim 10, wherein the shell includes a rear body integrally formed with the upper body and oriented approximately perpendicular to the upper body, the upper body coupled with the top sides of the mounted connectors and the rear body coupled with the rear sides of the mounted connectors.

* * * * *